US009397427B2

(12) United States Patent
Ho

(10) Patent No.: US 9,397,427 B2
(45) Date of Patent: Jul. 19, 2016

(54) CARD EDGE CONNECTOR

(71) Applicant: Molex, LLC, Lisle, IL (US)

(72) Inventor: Yi-Tse Ho, Tainan Hsien (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/049,775

(22) Filed: Oct. 9, 2013

(65) Prior Publication Data

US 2014/0302719 A1 Oct. 9, 2014

(30) Foreign Application Priority Data

Oct. 9, 2012 (TW) ..... 101137270 A

(51) Int. Cl.

| | |
|---|---|
| ***H01R 24/00*** | (2011.01) |
| ***H01R 12/73*** | (2011.01) |
| ***H01R 12/72*** | (2011.01) |
| *H01R 13/405* | (2006.01) |

(52) U.S. Cl.

CPC ..... *H01R 12/732* (2013.01); *H01R 12/721* (2013.01); *H01R 12/725* (2013.01); *H01R 13/405* (2013.01)

(58) Field of Classification Search

CPC ..... H01R 12/73; H01R 12/717
USPC ..... 439/637, 62, 326
See application file for complete search history.

(56) References Cited

U.S. PATENT DOCUMENTS

| | | | | |
|---|---|---|---|---|
| 6,142,790 | A | 11/2000 | Niitsu | |
| 7,008,262 | B2 | 3/2006 | Tsai | |
| 7,198,519 | B2 * | 4/2007 | Regnier | H01R 12/725 439/637 |
| 7,442,089 | B2 * | 10/2008 | Regnier | H01R 13/26 439/637 |
| 7,833,068 | B2 * | 11/2010 | Bright | H01R 13/4367 439/733.1 |
| 8,858,237 | B2 * | 10/2014 | Hsu | H01R 13/514 439/60 |
| 2007/0173127 | A1 * | 7/2007 | Regnier | H01R 12/725 439/637 |
| 2009/0068897 | A1 * | 3/2009 | Jin | H01R 12/57 439/637 |
| 2012/0322313 | A1 * | 12/2012 | Hsu | H01R 13/514 439/629 |
| 2013/0045637 | A1 * | 2/2013 | Yen | H01R 12/83 439/637 |

FOREIGN PATENT DOCUMENTS

| | | |
|---|---|---|
| TW | I303117 B | 11/2008 |
| TW | M397621 U | 2/2011 |
| TW | M430023 U | 5/2012 |

* cited by examiner

*Primary Examiner* — Phuong Dinh
(74) *Attorney, Agent, or Firm* — Stephen L. Sheldon

(57) ABSTRACT

A card edge connector comprises a housing, a plurality of first terminals and a terminal block. The housing has a first wall and a second wall which are opposite to each other, a slot between the first wall and the second wall and a plurality of terminal grooves spaced apart from each other and provided in the first wall in a row. The first terminals are supported by the first wall and positioned in the terminal grooves. The terminal block comprises an insulative body engaged with the second wall and a plurality of second terminals spaced apart from each other and supported by the insulative body. Each of second terminals has a fixed portion fixedly provided to the insulative body, a contact portion extending out of the insulative body and extending into the slot, and a tail portion extending out of the insulative body.

9 Claims, 14 Drawing Sheets

CARD EDGE CONNECTOR

RELATED APPLICATIONS

This application claims priority to Taiwanese Application No. 101137270, filed Oct. 9, 2012, which is incorporated herein by reference in its entirety.

TECHNICAL FIELD

The present disclosure relates to a card edge connector.

BACKGROUND ART

Conventional card edge connector is used to provide on a circuit board and is inserted by an electronic card, has a housing, which can be formed of an insulative material, with a slot which is opened in a middle portion and is extends longitudinally, and two rows of terminals fixedly provided to the housing and positioned at both sides of the slot respectively. Typically, the terminal is mounted to the housing in a form of pin, as disclosed by Taiwanese Patent TWI303117B for example.

Since the terminal is fixed in the form of pin, the housing requires a sufficient thickness for barbs of the terminals to be fixed by interference therewith, thereby making an overall height of this type of the card edge connector higher, which can not meet market demand on thinness. Furthermore, if the thickness of the housing is reduced in order to meet the demand for thinness, the housing is easily punctured by the barb of the terminal because of the insufficient thickness of the housing. When the barb of the terminal punctures the housing, it will make the housing warped or even broken, at the same time coplanarity of the terminals in each row becomes worse and it is not beneficial to solder and fix the terminals on the circuit board.

SUMMARY OF THE INVENTION

Therefore, a card edge connector comprises a housing, a plurality of first terminals and at least one terminal block. The housing has a first wall and a second wall which are opposite to each other, a slot between the first wall and the second wall, and a plurality of first terminal grooves spaced apart from each other and provided to the first wall in a row, the first terminal grooves are communicated with the slot respectively. The first terminals are fixedly provided to the first wall and positioned in the first terminal grooves respectively. The each terminal block comprises an insulative body engaged with the second wall and a plurality of second terminals spaced apart from each other and provided to the insulative body in a row. The each second terminal has a fixed portion fixedly provided to the insulative body, a contact portion extending out of the insulative body and extending into the slot, and a tail portion extending out of the insulative body.

In an embodiment, the second wall has at least one mounting groove, the number of which corresponds to the number of the terminal block. The mounting groove is defined by a pressing surface and a pair of holding portions positioned at both ends of the pressing surface.

In an embodiment, the second wall further has at least one pair of protrusions provided and corresponding to the mounting groove. The pair of protrusions oppositely protrudes into the mounting groove from the pair of holding portions. The insulative body has two end faces opposite to the holding portions respectively, a pressed surface abutting against the pressing surface, and two recessed grooves recessed from the end faces respectively to received the protrusions respectively and further leave clearances, so that the insulative body can be floatingly received in the mounting groove.

In an embodiment, the pressing surface presses against the pressed surface so as to limit the insulative body to moving toward the first wall. In an embodiment, the pressing surface and the pressed surface are angled so as to mutually cooperate. In an embodiment, the housing is fixed to a circuit board and the second wall is adjacent to the circuit board, the pressing surface is angled toward the circuit board, the terminal block can float relative to the circuit board so as to allow the tail portions of the second terminals to contact the circuit board. In an embodiment, the insulative body further has a bottom surface adjacent to the circuit board, and the recessed grooves extend through the bottom surface. In an embodiment, the each second terminal further has a curved portion extended out of the insulative body and positioned between the fixed portion and the contact portion. The housing further has a plurality of second terminal grooves spaced apart from each other and provide to the second wall in a row, the second terminal grooves are communicated with the slot respectively, the second wall further has a reinforcing portion successively connecting the second terminal grooves and protruding toward the curved portions of the second terminals.

In an embodiment, the insulative body and the second terminals of the each terminal block are integrally molded by insert molding. The effects of the present disclosure are as follows. By that the terminal block can be integrally molded by insert molding, it can reduce the overall height of the card edge connector so as to meet the demand on thinness. Furthermore, having the terminal block floatingly received in the mounting groove can increase the ability to solder the second terminals. Moreover, that the pressing surface of the second wall presses against the insulative body can prevent the insulative body from warping so as to ensure that the second terminals and the circuit board are stably electrically connected. In addition, the second wall has the reinforcing portion so as to increase the structural strength and dimensional stability.

BRIEF DESCRIPTION OF THE DRAWINGS

The present invention is illustrated by way of example and not limited in the accompanying figures in which like reference numerals indicate similar elements and in which.

DETAILED DESCRIPTION OF THE PREFERRED EMBODIMENTS

Figure 1:
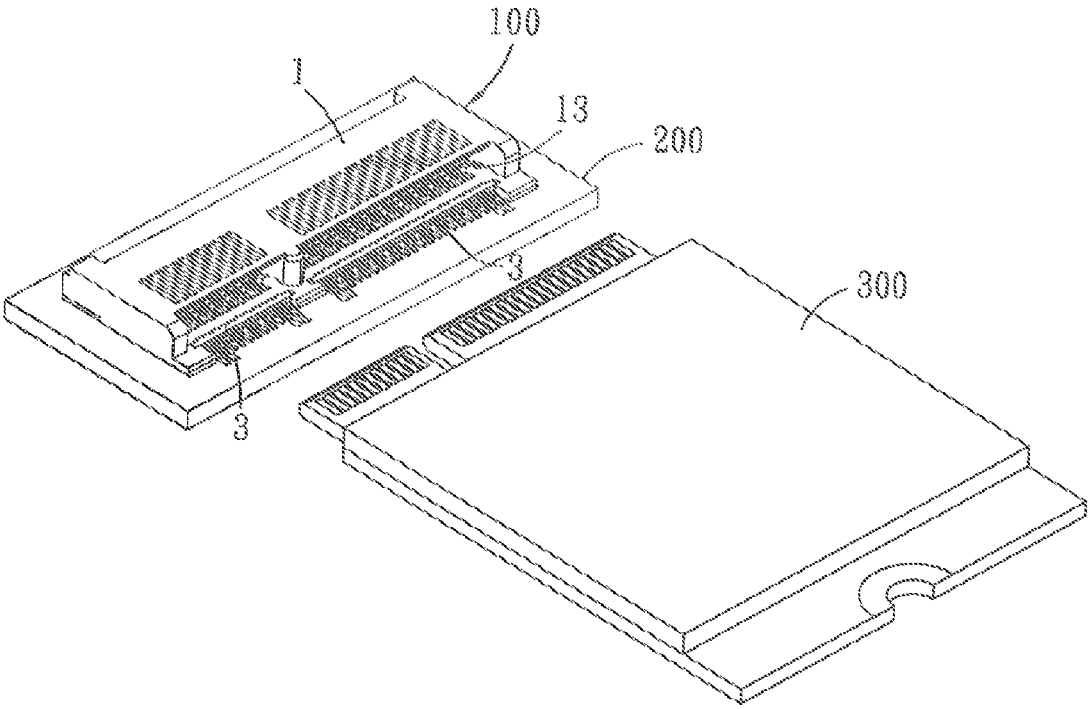
FIG. 1 is a perspective view illustrating a first embodiment of a card edge connector which is mounted to a circuit board and into which an electronic card will be inserted.

The foregoing and other technical contents, features and effects of the present disclosure will be apparent through the following detailed description for two specific embodiments in combination with the drawings.

Hereafter, an object of the present disclosure is to provide a card edge connector with a lower overall height. Another object of the present disclosure is to provide a card edge connector which will not warp. Another object of the present disclosure is to provide a card edge connector which can increase coplanarity of terminals so as to allow the terminals to be beneficially soldered to a circuit board. Another object of the present disclosure is to provide a card edge connector with an increased structural strength and dimensional stability.

It should be noted that like elements are identified by the same reference numerals in the following description before the present disclosure will be described in details.

Figure 2:
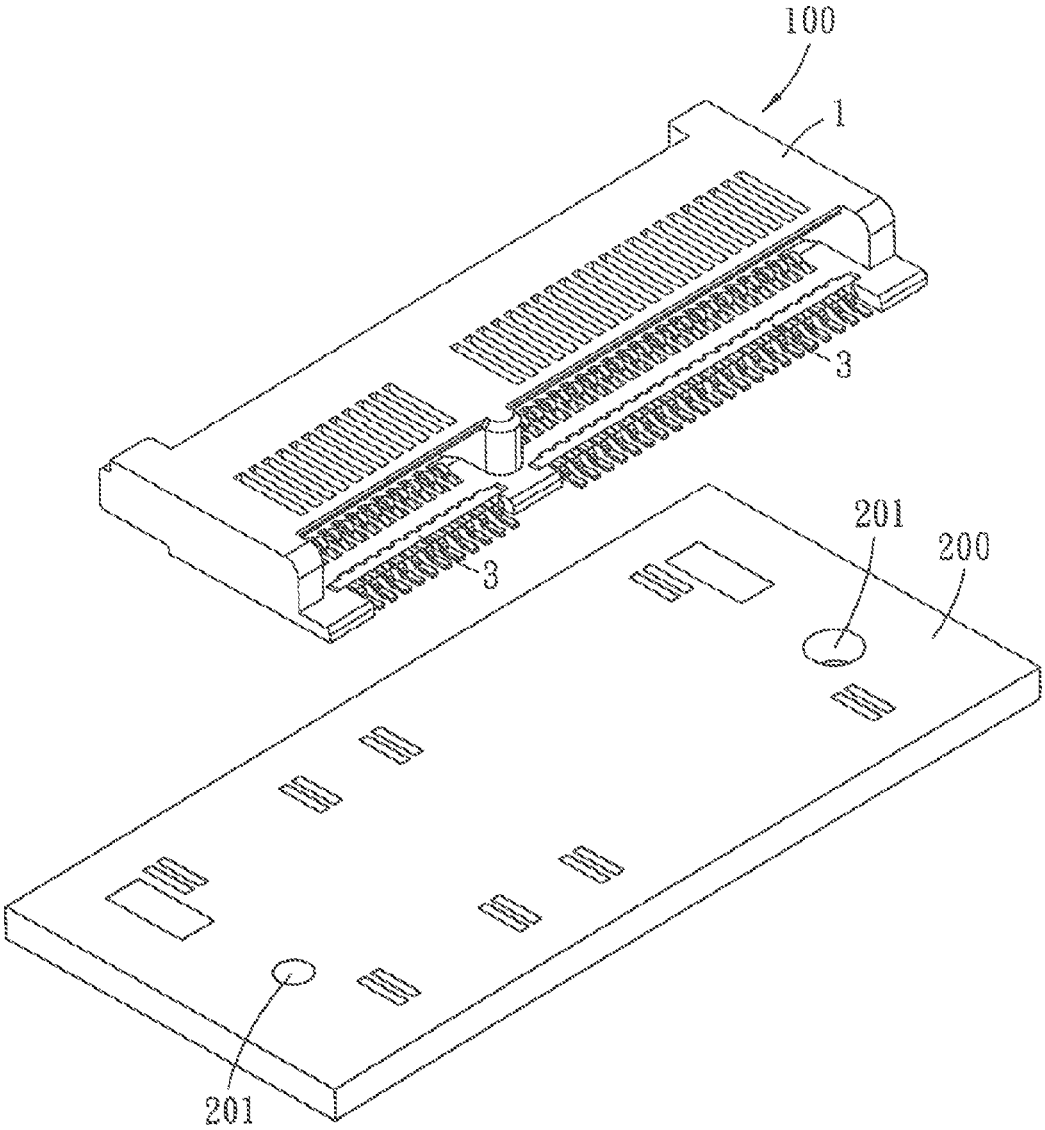
FIG. 2 is a perspective view illustrating an assembly relationship of the first embodiment and the circuit board.
Figure 3:
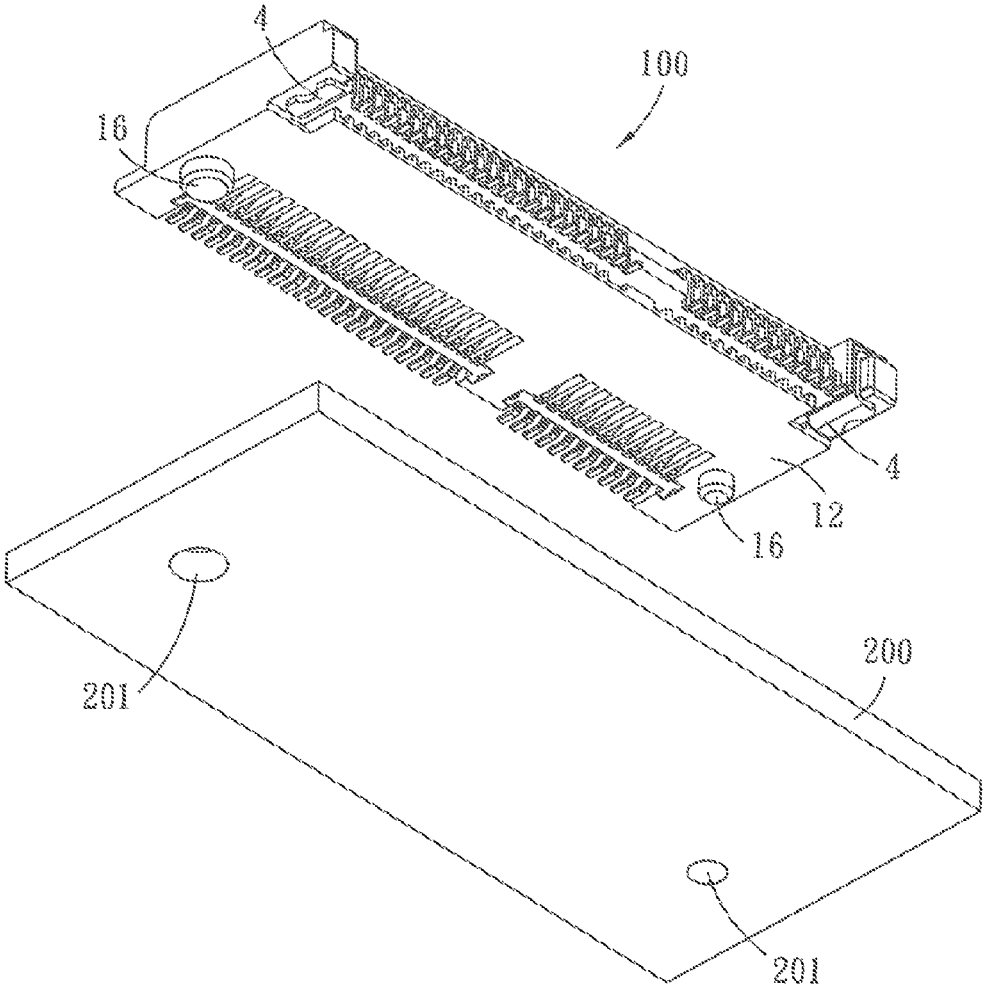
FIG. 3 is a view of FIG. 2 viewed from another angle.

Referring to FIGS. 1-3, a card edge connector 100 of a first embodiment of the present disclosure is suitably mounted to a circuit board 200 and is inserted by an electronic card 300.

Referring to FIG. 1 and FIGS. 3-5, the card edge connector 100 comprises an housing 1, a plurality of first terminals 2 and two terminal blocks 3. The housing 1 has a first wall 11 and a second wall 12 which are opposite to each other, a slot 13 between the first wall 11 and the second wall 12, and a plurality of first terminal grooves 14 spaced apart from each other and provided to the first wall 11 in a row, and a plurality of second terminal grooves 15 spaced apart from each other and provided to the second wall 12 in a row. The first terminal grooves 14 and the second terminal grooves 15 are communicated with the slot 13 respectively. The housing 1 further has two positioning posts 16 spaced apart from each other and protruding outwardly from the second wall 12 so as to be fixed to the circuit board 200. The positioning posts 16 are not identical in diameter and correspondingly insert into two through holes 201 in the circuit board 200 which are not identical in diameter. Shapes and sizes of the through holes 201 are matched to those of the positioning posts 16 respectively, thereby preventing opening of the slot 13 of the card edge connector 100 from facing an opposite direction. In addition, the housing 1 is provided with two metal soldering pieces 4 to be soldered to the circuit board 200 so as to fix the housing 1 to the circuit board 200. When the housing 1 is mounted and fixed to the circuit board 200, the second wall 12 is adjacent to the circuit board 200.

Figure 7:
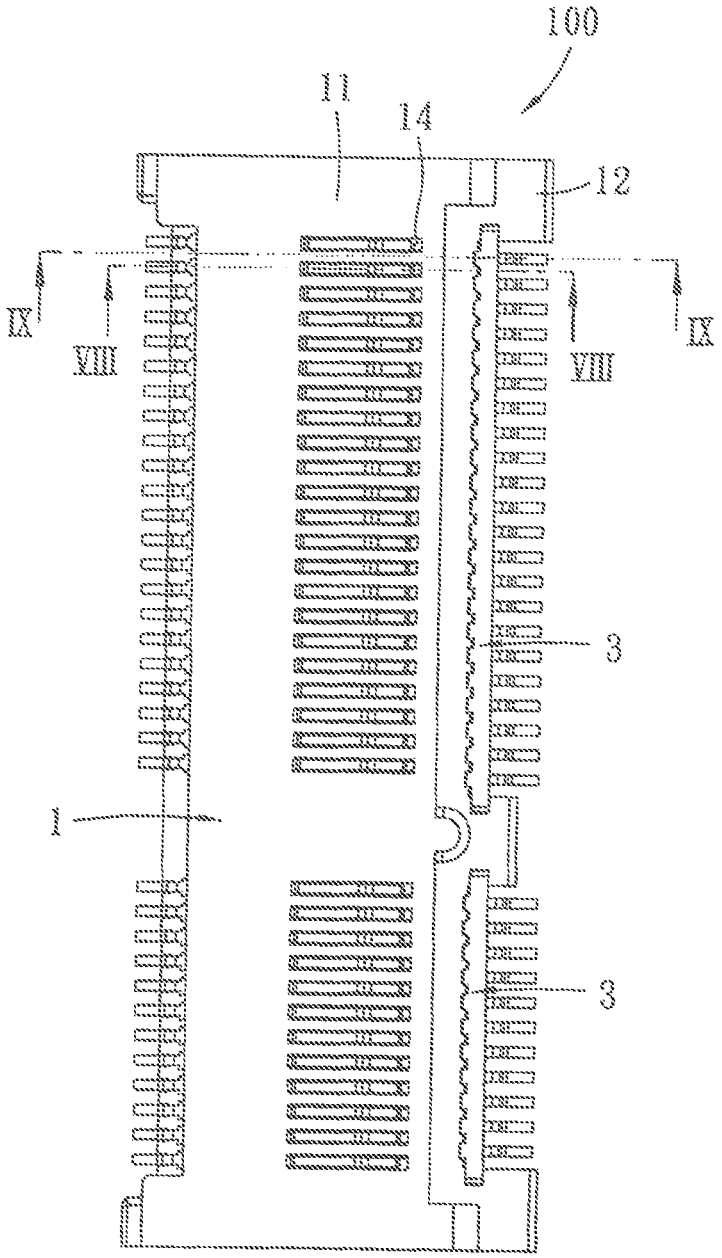
FIG. 7 is a top view illustrating the first embodiment.
Figure 8:
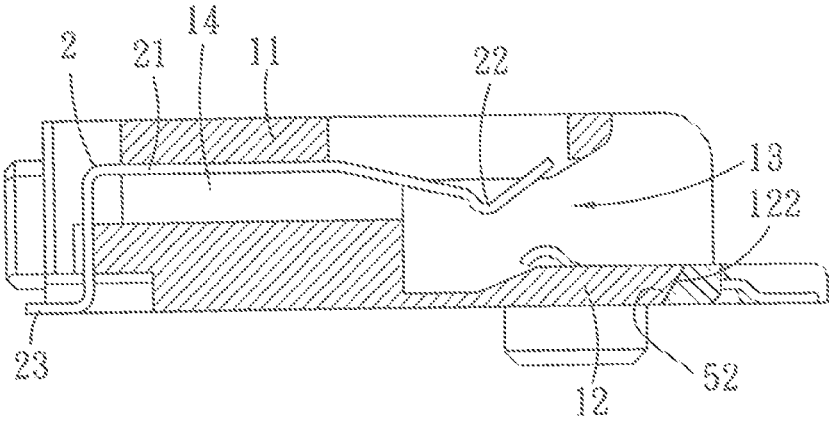
FIG. 8 is a cross-sectional view taken along a line VIII-VIII of FIG. 7.

In combination with referring to FIG. 7 and FIG. 8, the first terminals 2 are fixedly provided to the first wall 11 and positioned into the first terminal grooves 14 respectively. The each first terminal 2 has a fixed portion 21 fixed to the housing 1 by interference, a contact portion 22 extending into the slot 13, and a tail portion 23 extending out of the housing 1 to be soldered to the circuit board 200.

Referring to FIGS. 4-9, the each terminal block 3 comprises an insulative body 5 engaged with the second wall 12 and a plurality of second terminals 6 spaced apart from each other and provided to the insulative body 5 in a row. The each second terminal 6 has a fixed portion 61 fixedly provided to the insulative body 5, a contact portion 62 extending out of the insulative body 5, passing through the corresponding second terminal groove 15 and entering into the slot 13, and a tail portion 63 extending out of the insulative body 5 in a direction opposite to the contact portion 62. In the embodiment, the insulative body 5 and the second terminals 6 of the each terminal block 3 are integrally molded by insert molding, which can reduce the overall height of the card edge connector 100.

Figure 4:
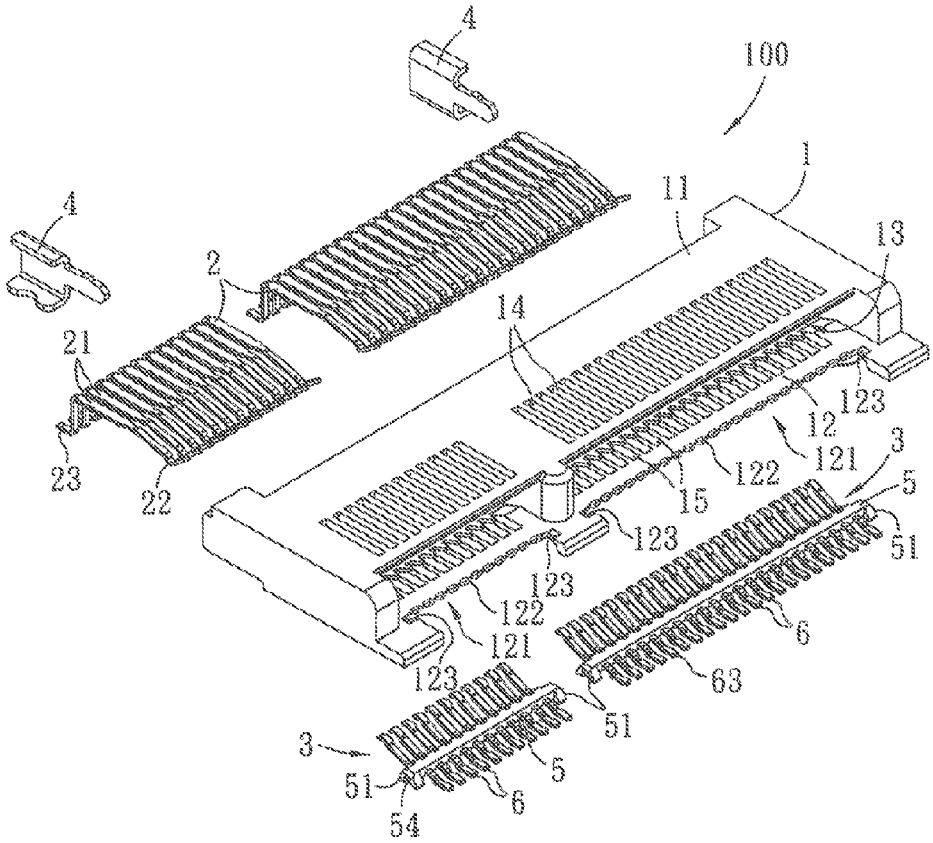
FIG. 4 is an exploded perspective view illustrating the first embodiment.
Figure 5:
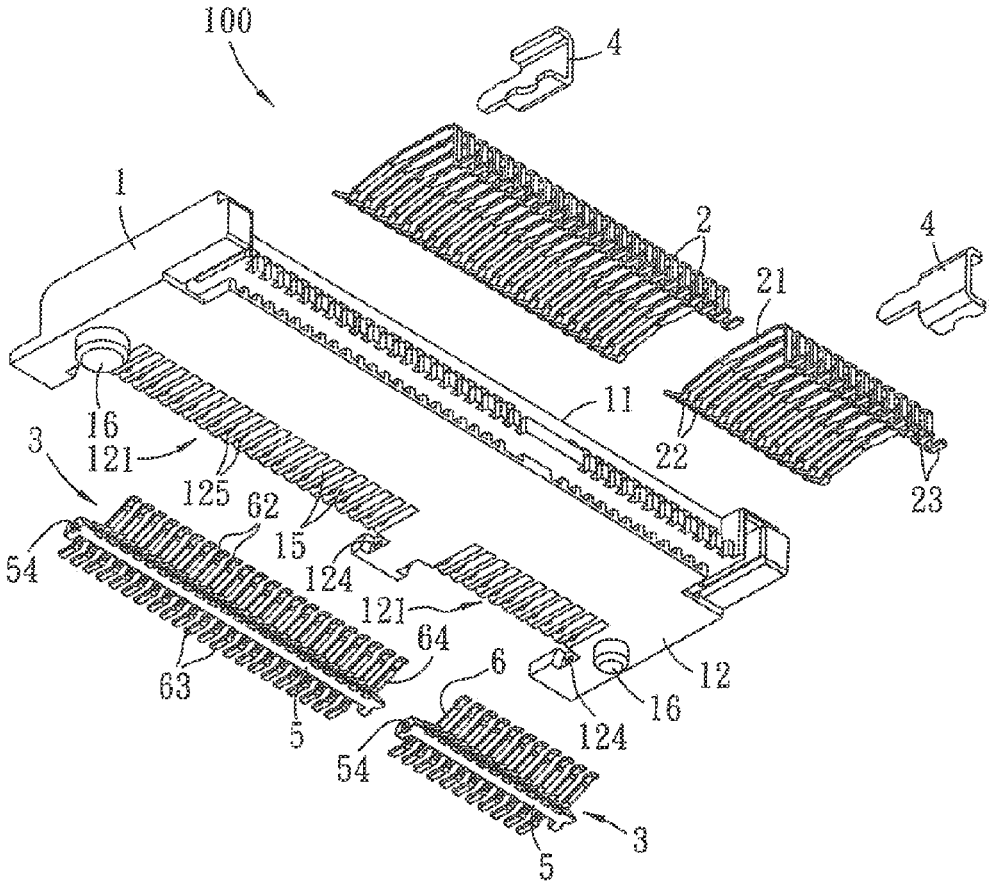
FIG. 5 is a view of FIG. 4 viewed from another angle.
Figure 6:
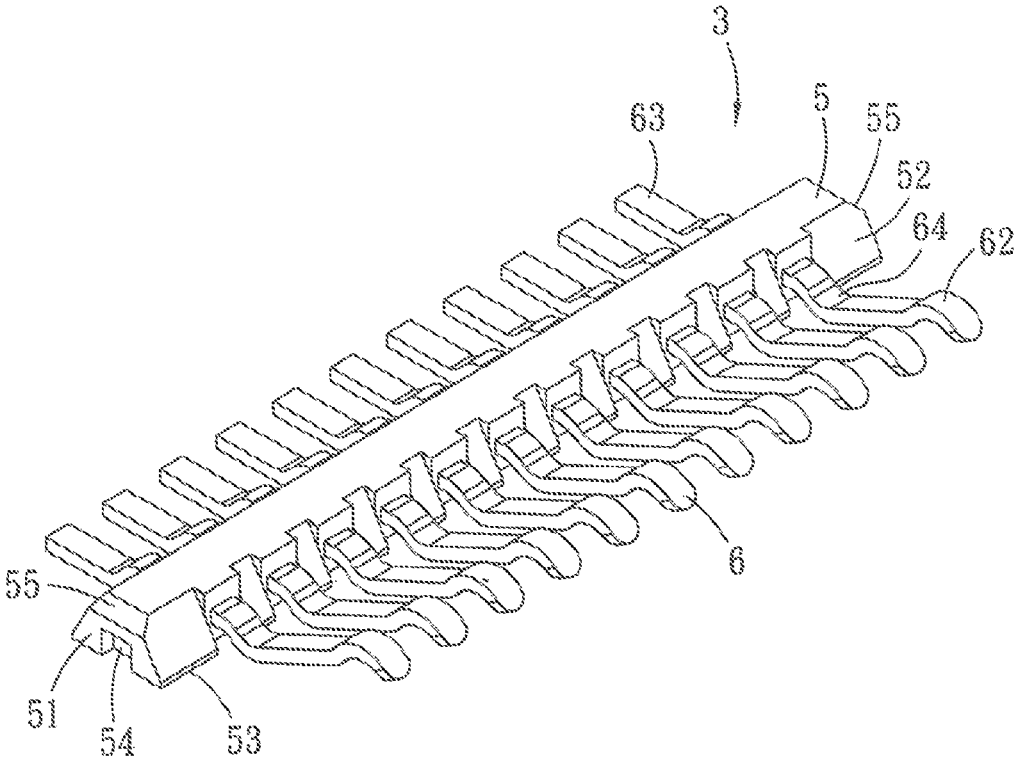
FIG. 6 is a perspective view illustrating a terminal block of the first embodiment.
Figure 10:
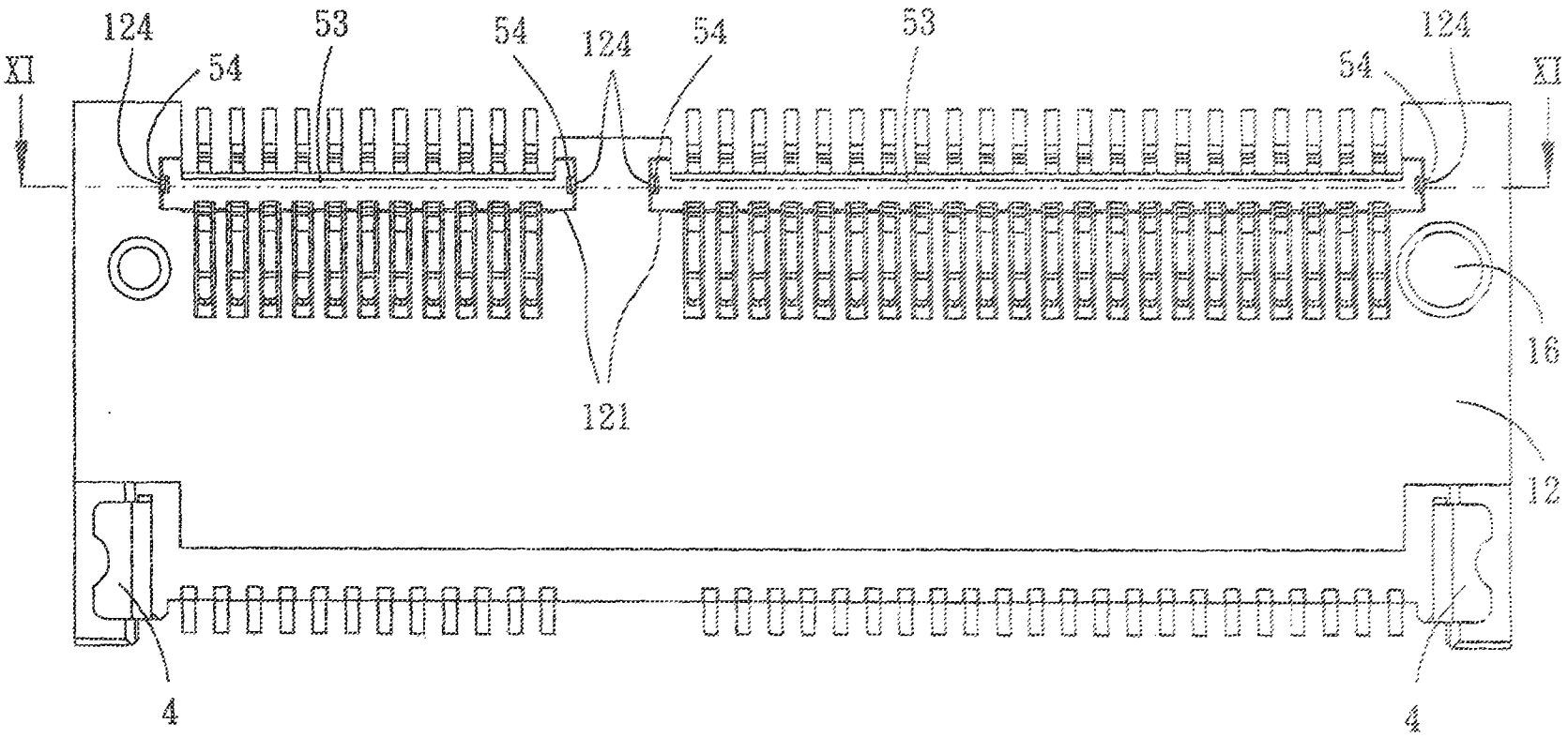
FIG. 10 is a bottom view illustrating the first embodiment.
Figure 11:
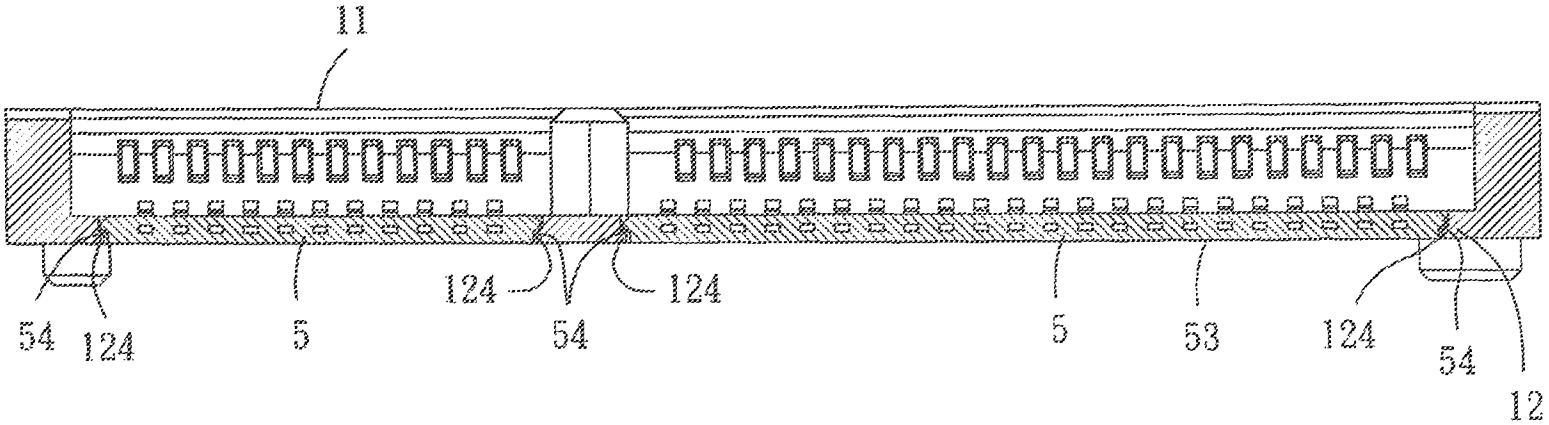
FIG. 11 is a cross-sectional view taken along a line XI-XI of FIG. 10 illustrating that the terminal block of the first embodiment can float.

Referring to FIGS. 4-6, the second wall 12 has two mounting grooves 121, the number of the mounting groove 121 corresponds to the number of the terminal block 3. The each mounting groove 121 is defined by a pressing surface 122 and a pair of holding portions 123 positioned at both ends of the pressing surface 122. The second wall 12 further has two pairs of protrusions 124 provided and corresponding to the mounting groove 121. The each pair of protrusions 124 oppositely protrudes into the mounting groove 121 respectively from the corresponding pair of holding portions 123. The each insulative body 5 has two end faces 51 opposite to the two holding portions 123 respectively, a pressed surface 52 abutting against the pressing surface 122, a bottom surface 53 adjacent to the circuit board 200, and two recessed grooves 54 recessed from the two end faces 51 respectively and receiving the two protrusions 124 respectively. And the recessed grooves 54 extend through the bottom surface 53. In combination with referring to the FIG. 10 and FIG. 11, the insulative body 5 is placed into the mounting groove 121 along a direction from the second wall 12 toward the first wall 11, and easily slides relative to the protrusions 124 by means of guide slopes 55 adjacent to the two end faces 51 so as to allow a part of the insulative body 5 above upper edges of the recessed grooves 54 to easily pass through the protrusions 124. Moreover, the holding portions 123 opposite to each other on the housing 1 may be resiliently expanded to allow the insulative body 5 to pass through, and return to their original positions when the recessed grooves 54 reach corresponding positions of the protrusions 124. In addition, the pressing surface 122 of the housing 1 presses against the pressed surface 52 of the insulative body 5 (referring to FIG. 8 and FIG. 12) so as to limit the insulative body 5 to moving toward the first wall 11. The recessed grooves 54 receive the corresponding protrusions 124 and further leave clearances so as to allow that the insulative body 5 can be floatingly received in the mounting groove 121. That is, the terminal block 3 can float relative to the circuit board 200 so as to allow the tail portions 63 of the second terminals 6 to contact the circuit board 200 and avoid poor soldering. Specifically, since the insulative body 5 is floatingly received in the mounting groove 121, a mounting angle of the insulative body 5 relative to the housing 1 can be adjusted, thereby allowing all the tail portions 63 of the second terminals 6 to abut against the surface of the circuit board 200 and allowing the tail portions 63 of the second terminals 6 to be reliably soldered and fixed to the circuit board 200 so as to form an electrical connection, that is, the ability to solder is improved.

Figure 12:
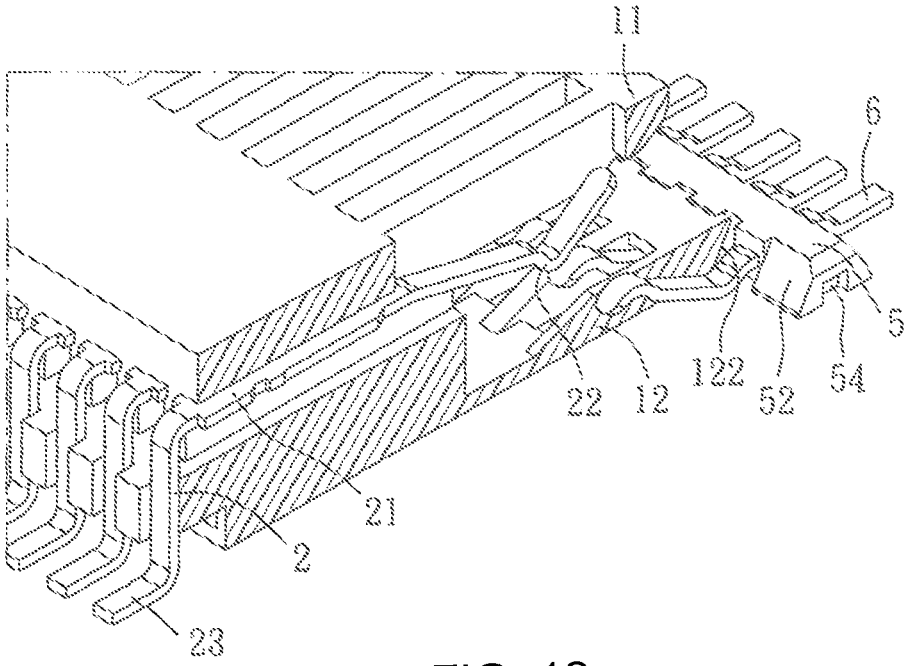
FIG. 12 is a partial cut-away perspective view illustrating a pressing surface of the housing of the first embodiment presses against the insulative body of the terminal block.

Referring to FIG. 8 and FIG. 12, by that the pressing surface 122 of the housing 1 presses against the pressed surface 52 of the insulative body 5, it not only can limit the insulative body 5 not to moving out upwardly from the mounting groove 121, but also can prevent the insulative body 5 from warping so as to ensure that the second terminals 6 can be stably electrically connected to the circuit board 200. In the depicted embodiment the pressing surface 122 and the pressed surface 52 are angled surfaces which mutually cooperate, but the angled surfaces may be step surfaces or other equivalent structures which mutually cooperate.

Figure 9:
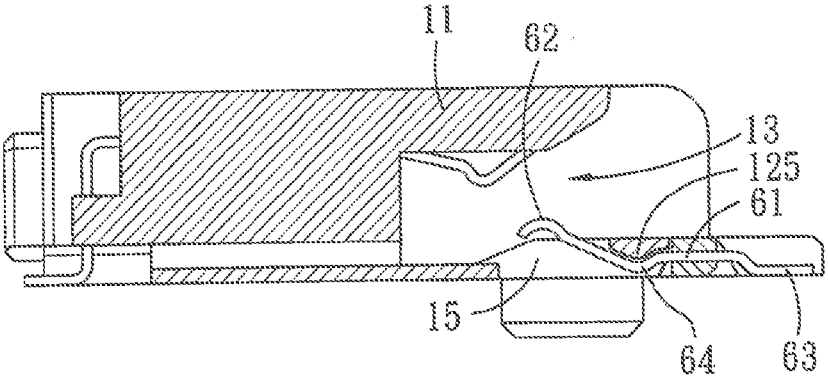
FIG. 9 is a cross-sectional view taken along a line IX-IX of FIG. 7.
Figure 13:
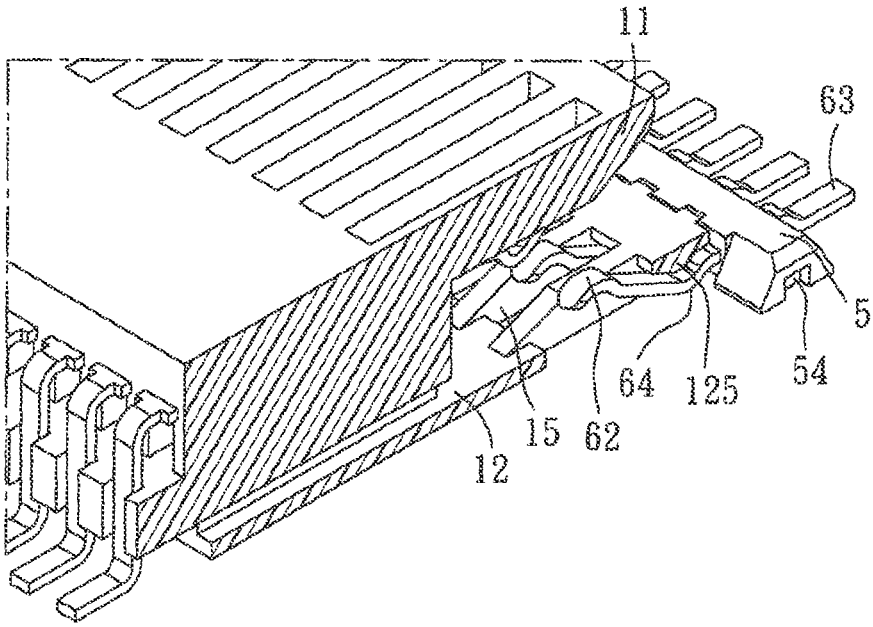
FIG. 13 is a partial cut-away perspective view illustrating a reinforcing portion of the housing of the first embodiment.
Figure 14:
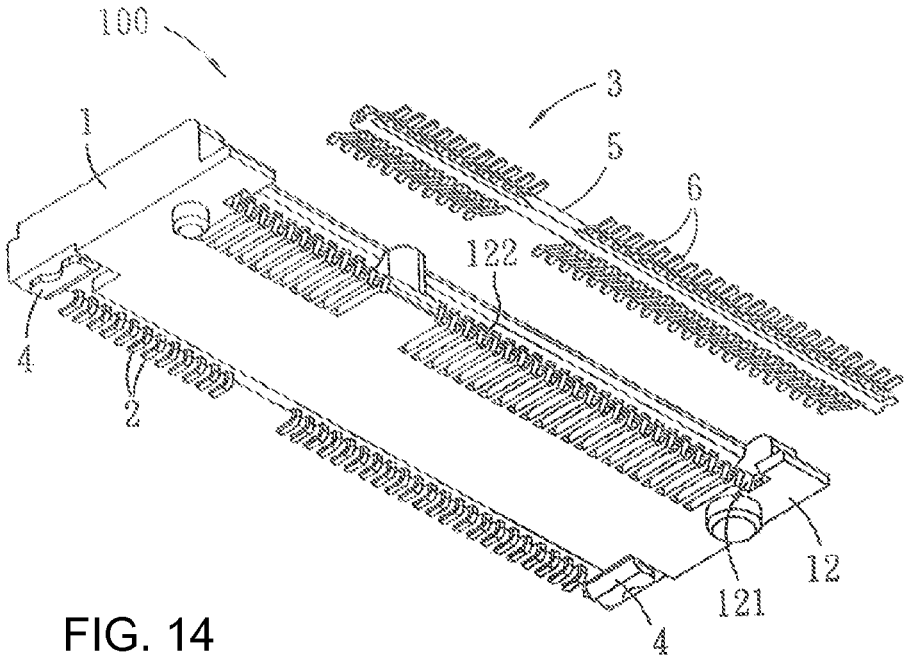
FIG. 14 is an exploded perspective view illustrating a card edge connector of a second embodiment of the present disclosure.
Figure 15:
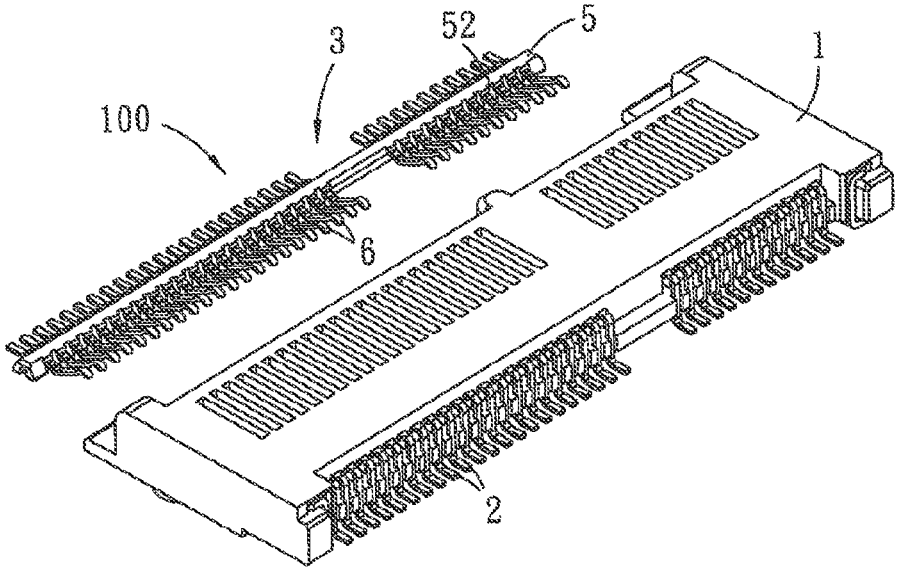
FIG. 15 is a view of FIG. 14 viewed from another angle.
Figure 16:
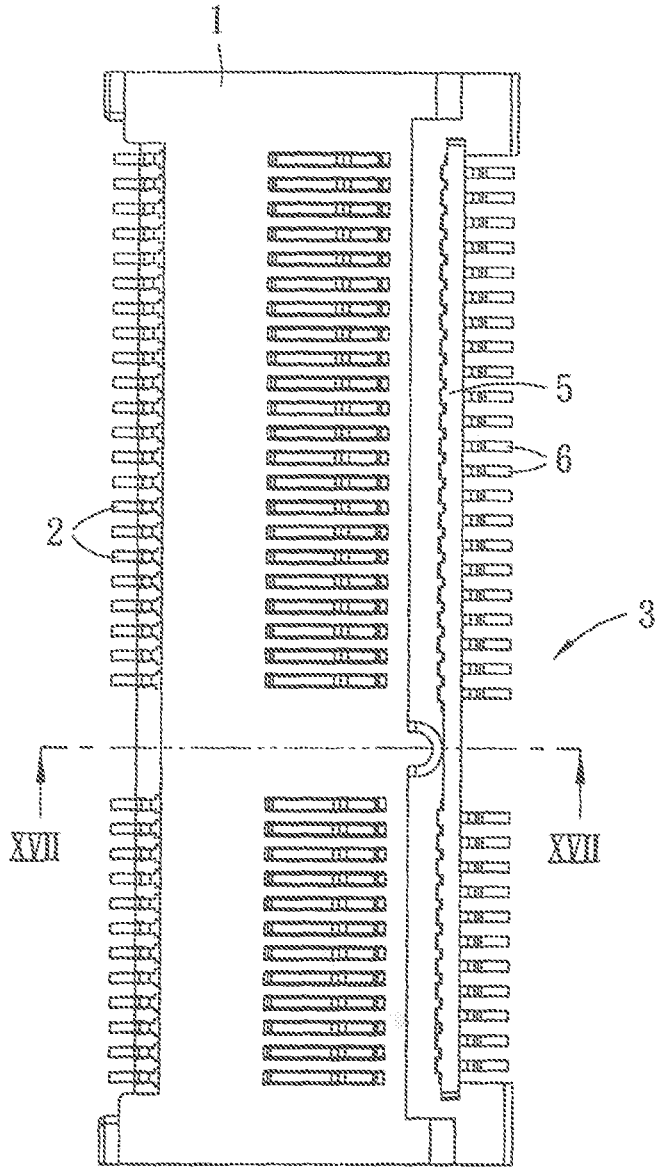
FIG. 16 is a top view illustrating.
Figure 17:
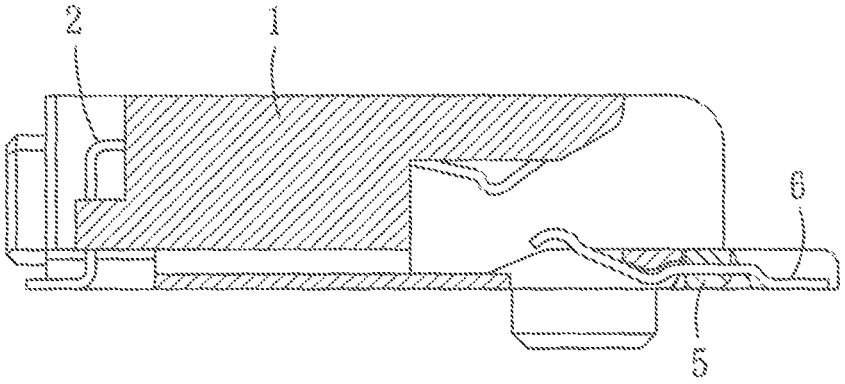
FIG. 17 is a cross-sectional view taken along a line XVII-XVII of FIG. 16.

Referring to FIG. 5, FIG. 9 and FIG. 13, the each second terminal 6 further has a curved portion 64 extending out of the insulative body 5 and positioned between the fixed portion 61 and the contact portion 62. The second wall 12 further has a reinforcing portion 125 successively connecting the second terminal grooves 15 and protruding toward the curved portions 64 of the second terminals 6. Structural strength and dimensional stability of the second wall 12 are increased by the reinforcing portions 125.

Referring to FIGS. 14-17, a card edge connector 100 of a second embodiment of the present disclosure is substantially the same as that of the first embodiment, but differences lie in that a terminal block 3 in the second embodiment is an unitary one integrally connected, and the number of the mounting groove 121 on the housing 1 is correspondingly adjusted as one in conforming to the number of the terminal block 3. Similarly, in the second embodiment, the terminal block 3 can also float relative to the housing 1 so as to increase the ability to solder the second terminals 6. Moreover, the pressed surface 52 of the insulative body 5 of the terminal block 3 is pressed by the pressing surface 122 of the housing 1, which can prevent the insulative body 5 from warping.

In conclusion, by that the terminal block 3 can be integrally molded by insert molding, it can reduce the overall height of the card edge connector 100 so as to meet the demand on thinness. Furthermore, that the terminal block 3 can be floatingly received in the mounting groove 121 can increase the ability of soldering the second terminals 6. Moreover, that the pressing surface 122 of the second wall 12 presses against the insulative body 5 can prevent the insulative body 5 from warping so as to ensure that the second terminals 6 and the circuit board 200 are stably electrically connected. In addition, the second wall 12 has the reinforcing portion 125 so as to increase the structural strength and dimensional stability.

However, what have been described above are only embodiments of the present disclosure, the implementation scope of the present disclosure is not limited to that, that is, simple equivalent variations and modifications made according to the Claims and the description content of the present disclosure are still included in the protective scope of the present disclosure.

What is claimed is:

1. A card edge connector, comprising:

a housing having a first wall and a second wall which are opposite to each other, a slot between the first wall and the second wall, and a plurality of first terminal grooves spaced apart from each other and provided to the first wall in a row, the first terminal grooves being communicated with the slot respectively;

a plurality of first terminals fixedly provided to the first wall and positioned in the first terminal grooves respectively; and a terminal block, the terminal block comprising an insulative body engaged with the second wall and a plurality of second terminals spaced apart from each other and provided to the insulative body in a row, each of the plurality of second terminals having a fixed portion fixedly provided to the insulative body, a contact portion extending out of the insulative body and extending into the slot, and a tail portion extending out of the insulative body, wherein the second wall has a mounting groove that corresponds the terminal block, the mounting groove having a first pressing surface and a pair of holding portions positioned at both ends of the first pressing surface and wherein the second wall further has a pair of protrusions provided and corresponding to the mounting groove, the pair of protrusions oppositely protruding into the mounting groove from the pair of holding portions, wherein the insulative body includes two end faces opposite to the holding portions respectively, a pressed surface abutting against the first pressing surface and two recessed grooves recessed from the end faces respectively to received the protrusions respectively and further leave clearances, wherein the insulative body can be floatingly received in the mounting groove.

2. The card edge connector of claim 1, wherein the first pressing surface presses against the pressed surface so as to limit the insulative body from moving toward the first wall.

3. The card edge connector of claim 2, wherein the housing is fixed to a circuit board and the second wall is adjacent to the circuit board, the first pressing surface angled toward the circuit board, wherein the terminal block can float relative to the circuit board so as to allow the tail portions of the second terminals to contact the circuit board.

4. The card edge connector of claim 3, wherein the insulative body further has a bottom surface adjacent to the circuit board, and the recessed grooves extend through the bottom surface.

5. The card edge connector of claim 1, wherein the second terminals are insert molded into the insulative body.

6. The card edge connector of claim 1, wherein the tail portions of the second terminals extend toward a direction that is away from the contact portions.

7. A card edge connector, comprising:

a housing having a first wall and a second wall which are opposite to each other, a slot between the first wall and the second wall, and a plurality of first terminal grooves spaced apart from each other and provided to the first wall in a row, the first terminal grooves being communicated with the slot respectively;

a plurality of first terminals fixedly provided to the first wall and positioned in the first terminal grooves respectively; and a terminal block, the terminal block comprising an insulative body engaged with the second wall and a plurality of second terminals spaced apart from each other and provided to the insulative body in a row, each of the plurality of second terminals having a fixed portion fixedly provided to the insulative body, a contact portion extending out of the insulative body and extending into the slot, and a tail portion extending out of the insulative body, wherein the second wall has a mounting groove that corresponds to the terminal block, the mounting groove including a first pressing surface and a pair of holding portions positioned at both ends of the first pressing surface, and the insulative body is received in the mounting groove and has a pressed surface abutting against the first pressing surface, the first pressing surface presses against the pressed surface so as to limit the insulative body to moving toward the first wall.

8. The card edge connector of claim 7, wherein each second terminal further has a curved portion extended out of the insulative body and positioned between the fixed portion and the contact portion; the housing further has a plurality of second terminal grooves spaced apart from each other and provide to the second wall in a row, the second terminal grooves are communicated with the slot respectively, the second wall further has a reinforcing portion successively connecting the second terminal grooves and protruding toward the curved portions of the second terminals.

9. The card edge connector of claim 7, wherein the first pressing surface and the pressed surface are angled in a cooperative manner.

* * * * *